US008991231B2

(12) United States Patent
Charre et al.

(10) Patent No.: US 8,991,231 B2
(45) Date of Patent: Mar. 31, 2015

(54) ROLL STAND

(75) Inventors: Francis Charre, Balbiny (FR); Yves Guillot, Trelins (FR); Bernard Rossigneux, Lezigneux (FR)

(73) Assignee: PriMetals Technologies, Camberley (GB)

( * ) Notice: Subject to any disclaimer, the term of this patent is extended or adjusted under 35 U.S.C. 154(b) by 238 days.

(21) Appl. No.: 13/582,126

(22) PCT Filed: Apr. 1, 2010

(86) PCT No.: PCT/EP2010/054449

§ 371 (c)(1), (2), (4) Date: Aug. 31, 2012

(87) PCT Pub. No.: WO2011/107165

PCT Pub. Date: Sep. 9, 2011

(65) Prior Publication Data

US 2012/0324973 A1 Dec. 27, 2012

(30) Foreign Application Priority Data

Mar. 3, 2010 (EP) ..... 10290105

(51) Int. Cl.
*B21B 13/14* (2006.01)
*B21B 29/00* (2006.01)

(52) U.S. Cl.
CPC ..... *B21B 13/145* (2013.01); *B21B 29/00* (2013.01)
USPC ..... 72/240

(58) Field of Classification Search
CPC ..... B21B 13/14; B21B 13/145; B21B 29/00
USPC ..... 72/237, 240, 242.4, 243.2, 244, 248
See application file for complete search history.

(56) References Cited

U.S. PATENT DOCUMENTS

| | | | | |
|---|---|---|---|---|
| 3,533,263 | A | 10/1970 | Wochnik et al. | |
| 4,197,731 | A | 4/1980 | Verbickas et al. | |
| 4,270,377 | A | 6/1981 | Verbickas et al. | |
| 4,462,236 | A | 7/1984 | Turley et al. | |
| 4,531,394 | A | 7/1985 | Turley et al. | |
| 4,539,834 | A * | 9/1985 | Iwanami | 72/243.2 |
| 4,918,965 | A | 4/1990 | Kobayashi et al. | |
| 5,007,273 | A * | 4/1991 | Kummerhoff | 72/242.2 |
| 6,041,636 | A | 3/2000 | Datzuk et al. | |
| 7,104,101 | B1 | 9/2006 | Berger et al. | |
| 7,481,089 | B2 | 1/2009 | Valence et al. | |
| 7,665,339 | B2 * | 2/2010 | Valence et al. | 72/238 |
| 2006/0010952 | A1 | 1/2006 | Valence et al. | |
| 2008/0115551 | A1 | 5/2008 | Marc et al. | |

FOREIGN PATENT DOCUMENTS

| | | |
|---|---|---|
| DE | 33 25 493 A1 | 1/1985 |
| EP | 0 277 248 A1 | 8/1988 |

(Continued)

*Primary Examiner* — Teresa M Ekiert
(74) *Attorney, Agent, or Firm* — Laurence A. Greenberg; Werner H. Stemer; Ralph E. Locher

(57) ABSTRACT

A roll stand has two working rollers capable of gripping a strip to be rolled, two intermediate rollers, two bearing rollers, and at least one side bearing unit capable of laterally supporting the working rollers. At least one camber block for cambering the intermediate rollers is capable of vertical movement relative to the posts of the roll stand and of supporting the side bearing unit.

15 Claims, 7 Drawing Sheets

(56) References Cited

FOREIGN PATENT DOCUMENTS

| | | | |
|---|---|---|---|
| EP | 0 937 517 | A2 | 8/1999 |
| WO | 01/21334 | A1 | 3/2001 |
| WO | 2004/041456 | A1 | 5/2004 |
| WO | 2004/052568 | A1 | 6/2004 |

* cited by examiner

ROLL STAND

BACKGROUND OF THE INVENTION

Field of the Invention

The present invention relates to a roll stand used to equip a rolling installation.

The present invention relates in particular to the field of metal strip rolling, in particular special steels such as stainless steels, using a rolling installation generally including at least one roll stand. More particularly, the present invention relates to a roll stand of said rolling installation and its operation, said stand being intended for rolling any type of metal and, in particular, intended for rolling stainless steels.

Traditionally, a roll stand is fitted with two working rollers stacked vertically, each having its longitudinal axis of rotation parallel to the plane of travel of the metal strip and placed in a single gripping plane perceptibly perpendicular to the direction of travel of the strip between said working rollers. During rolling, the working rollers are generally pressed against each other by a pair of bearing rollers each having its longitudinal axis in said single gripping plane (or close to said gripping plane) and between which a rolling pressure, or load, is applied. Such a rolling installation including a roll stand formed of four rollers stacked vertically, i.e. two working rollers of small diameter pressed against each other by two bearing rollers of larger diameter, is called "quarto". If another support roller, hereinafter called an intermediate roller, is inserted between each of the pairs formed by the working roller and the bearing roller positioned on the same side of the strip to be rolled, the roll stand is then made up of six rollers stacked vertically one on top of the other, i.e. one pair of working rollers gripping the strip to be rolled, flanked by a first pair of rollers made up of the intermediate rollers, themselves flanked by a second pair of rollers made up of the bearing rollers. A rolling installation or rolling mill characterized by such an arrangement of rollers is usually called a "sexto" or "6-High". Finally, a roll stand of a rolling mill of the sexto type may include side supports for the working rollers. In particular, each of the working rollers is in contact on each side of the gripping plane with a side bearing unit, including for example a side support roller, itself supported laterally by two rows of side bearing guide wheels mounted side by side. Sexto rolling mills including said side bearing units are generally described as laterally supported sexto type rolling mills. In all cases, the rollers rest on or against one another along perceptibly parallel lines of support oriented along a generating line whose profile, normally rectilinear, depends on the loads applied and the strength of the rollers.

Laterally supported sexto type roll stands are known to the person skilled in the art and are the subject in particular of U.S. Pat. No. 4,270,377 and U.S. Pat. No. 4,531,394. The justification for this particular arrangement of the different rollers and wheels lies in the adaptation of the diameter of the working rollers to the resistance to the plastic flow of the metal to be rolled. In fact, working rollers of large diameter, like those fitted to quarto type stands, induce, reduction in thickness being equal, a large arc of contact with the strip and consequently a greater rolling force than with rollers of smaller diameter. For steels with moderate resistance to plastic flow, quarto type rolling mills are preferred, the large working rollers of which facilitate the stability of the rolling operation and wear less quickly. But, for certain steels such as stainless steels or other steels with a high yield point, the choice of working rollers of small diameter is required in order to retain reasonable rolling forces. For this reason, sexto type rolling mills including working rollers of small diameter are used and, when the hardness of the metal to be rolled so requires, working rollers of very small diameter have to be used, which pose problems of flexion during rolling.

In fact, the diameter of these working rollers is such that it is impossible to drive them directly, as is usual for rollers of greater diameter, for example using intermediate shafts transmitting to one of their ends the rolling torque originating from a motor reduction drive assembly. The torque is then transmitted, in the case of these working rollers of small diameter, by friction on the intermediate rollers, which are themselves driven by a motor reduction drive assembly. This transmission by friction generates between the working roller and the intermediate roller a tangential load proportional to the torque transmitted. In the case of rollers of very small diameter, this tangential load gives rise to longitudinal flexion of the working roller leading to evenness defects in the rolled strip.

In order to avoid this harmful flexion, and as described in U.S. Pat. No. 4,270,377 and U.S. Pat. No. 4,531,394, each working roller is supported, at least on the side where the strip enters the working roller nip, by a side support roller, itself supported by two rows of guide wheels, the side support roller and wheels being fixed to support arms the position of which is adjustable so as to be adapted to different new or worn working roller diameters. Generally, each of the working rollers is supported laterally by a pair of side support rollers positioned on each side of the gripping plane, each of them being supported by said two rows of guide wheels.

U.S. Pat. No. 4,270,377 describes for example a roll stand including two working rollers, each being supported on the one hand vertically by an intermediate roller, itself supported by a bearing roller, and also, on the other hand, laterally by two side support rollers themselves supported by two rows of support wheels. In the embodiment disclosed by the above mentioned patent, the working rollers are not supported and held in place by means of chocks, but are simply held axially by two axial thrust bearings. Also, each side support roller and its two rows of wheels are carried by a support arm articulated on a chock of the bearing roller and have a unit for radial movement relative to the working roller. The chocks of the intermediate rollers are also fitted with jacks for cambering said working rollers. They are also fitted with special bearings with no inner ring and with cylindrical rollers, which allow the intermediate rollers to move axially under the action of an axial movement unit mounted in one of the two chocks of each intermediate roller. Said axial movement corresponds to a movement of said intermediate roller along its longitudinal axis of rotation. The camber and axial movement of the intermediate rollers being, as is known, used to improve the evenness of the rolled metal strips.

The very small diameter of the working rollers requires greatly reduced values for the diameters of the intermediate rollers. U.S. Pat. No. 4,270,377 cites for example an intermediate roller diameter of 6 inches for a working roller of 2.25 inches. It follows that the chocks of the intermediate rollers are of reduced dimensions, which complicates the choice of a bearing capable of supporting the operating loads and, at the same time, providing for sliding relative to the spindle of the intermediate roller.

An improvement of a roll stand as described in U.S. Pat. No. 4,270,377 is disclosed in U.S. Pat. No. 4,531,394 and EP 0 937 517. These describe a roll stand for which each side support roller and its two rows of wheels are carried by a support arm articulated on the chock of the intermediate roller. Patent EP 0 937 517 also discloses a cassette including an intermediate roller, its chocks and its two side support rollers respectively supported by two rows of wheels. In this case, an axial movement system using hydraulic jacks provides for axial movement of the intermediate roller. Each intermediate roller includes two cylindrical roller bearings with no inner ring mounted in two chocks in which its spindles can slide axially. Finally, a third chock includes an assembly of bearings axially fixed to the end of the intermediate roller and at the same time providing for the take-up of the axial loads and the transmission of the axial movement to the intermediate roller.

The type of installation described above and the variants of assembly of the intermediate and side support rollers in cartridges derived from it, like that described in WO 2004/052568, present a certain number of disadvantages, in particular disadvantages associated with the integration of the side support rollers and their two rows of wheels with the chocks of the intermediate rollers or support rollers. This results in particular in complication of the operations to extract the intermediate rollers from the roll stand and complication of their reconditioning by means of grinding their active surface.

In fact, according to a widespread and proven method, the intermediate rollers can be ground with their chocks still mounted, which has the advantage of avoiding unnecessary dismantling time. In the case of intermediate rollers integrated with their side bearing units (i.e. each side bearing unit, including for example a side support roller and its bearing wheels, is integrated with the intermediate roller, or a support of said intermediate roller, for example the chocks of said intermediate roller), the grinding of the intermediate rollers with their chocks still mounted becomes impossible and, consequently, it is necessary to dismantle the assembly of parts formed by the intermediate roller and its side bearing units for each grinding.

Furthermore, all handling of said parts requires, particularly when this involves turning them, specific tools to prevent untimely and dangerous movements of roller supports and side bearing wheels.

Finally, it is necessary to stock as many complete assemblies as there are intermediate rollers in order to provide for rotation of said assemblies without any loss of time between the phase of mounting the assembly in the roll stand and the phase of workshop maintenance of the assembly. This results in an increase in the cost of the operational spare parts held in stock, in particular, the different assemblies, and an increase in the rotation time between said phases of mounting and maintenance resulting in particular from the need to dismantle all the constituent parts of said assemblies.

Another disadvantage results from the operating mode of the roll stands described above. In fact, according to a first operating mode, like that described in WO 2004/052568, the axial movement of the intermediate rollers is provided by axial sliding of the chocks, which gives rise to a relative movement of the side bearing units relative to the working rollers with the creation of axial thrusts capable on the one hand of damaging the axial thrust bearings of said working rollers and, on the other hand, of degrading the surface of said working rollers by rubbing on the side bearing units. Also, according to a second operating mode of roll stands described in the prior art, in particular by U.S. Pat. No. 4,270,377, the axial movement of the intermediate rollers is provided by axial sliding of their spindles relative to their chocks and thus relative to their bearings. This last operating mode presents the advantage of holding the chocks of the intermediate rollers axially fixed and avoiding any movement of the side bearing units, which are fixed relative to the working rollers during an axial movement of the intermediate rollers. However, this second operating mode presents numerous disadvantages.

In particular, the choice of bearings with no inner ring, characterized by cylindrical rollers rolling directly on the spindles of the intermediate rollers, requires particularly hard spindles which are difficult to achieve.

Also, said spindles present high risks of damage in service due to wear or flaking under the pressure of the cylindrical rollers with a correlative reduction in the service life of the intermediate rollers. Furthermore, it is very difficult to ensure good sealing of such bearings, which may lead to the use of rolling fluids, such as mineral oil, compatible with lubrication and the absence of corrosion of the bearings, while other fluids, such as emulsions, would be more appropriate for the needs of rolling. Finally, the intermediate rollers also have to be lengthened by the distance of axial movement of the intermediate roller, which increases the cost of procurement of the stock of intermediate rollers. Also, such stands sometimes require the use of a third chock. This third chock, fitted with sets of bearings capable of taking up the axial loads, gives rise to additional costs resulting from the need to have even longer rollers as well as additional chocks and bearings.

With a view to solving these problems, another roll stand configuration has been proposed, characterized in particular by integration of the side support rollers and their two rows of wheels, no longer with the chocks of the intermediate rollers or the bearing rollers, but with the posts of the roll stand. Such a configuration is in particular described in the applicant's patents WO 01/21334 or WO 2004/041456. According to this configuration, the intermediate rollers can easily be extracted from the roll stand and their maintenance can be carried out in the traditional way, i.e. without special tools and without dismantling the chocks of the intermediate rollers. However, it also presents certain disadvantages with respect to the kinematics of the roll stand.

A first disadvantage is interference between the working roller and the two side support rollers of the side bearing units during opening of the roll stand and consecutive vertical movement of the working rollers. In fact, the general arrangement of the working and side support rollers means that, in working position, the axes of rotation of the upper side support rollers are located above the axis of rotation of the upper working roller and that the distance between the two side support rollers, when in contact with the working roller, does not allow for the passage of the working roller upwards, i.e. in the direction of the upper bearing roller. The expression "upper" describes rollers or roll stand devices located above the plane of travel of the strip to be rolled, as against "lower", which describes rollers or roll stand elements located below the plane of travel of the strip to be rolled. Any vertical movement upwards of the upper working roller may therefore be hampered by the presence of the two upper side support rollers, which do not accompany the vertical movement of the upper working roller. Or, on the contrary, said vertical movement may take place with side support rollers too far apart, not providing for the lateral stability of the working roller. The situation is the opposite for the working and lower side support rollers, i.e. located below the plane of travel of the strip in the working roller nip.

Before any vertical movement of the working rollers, it is therefore necessary that the two side support rollers have without fail been moved away from the working roller by a distance sufficient not to hamper a vertical movement of the working roller, while still guaranteeing lateral stability of said working roller. This separation is carried out either by an operator, which is not reliable, or automatically, which is not guaranteed in the event of malfunction of a rolling installation control system performing this automatic function.

A second disadvantage is interference between the working roller and the two side support rollers of the side bearing units during closure of the stand and consecutive vertical movement of the working rollers. The interference between the working roller and the side support rollers results for example from poor positioning of the side support rollers during maintenance of the roll stand by an operator (position of the side support rollers too close relative to the position of the working roller) or during the installation of a new working roller with a diameter greater than the diameter of the working roller which has been replaced, or even during a malfunction of the roll stand or roller positioning errors. In all cases, there would be interference between the working roller and the side support rollers during closure of the roll stand.

Finally, a third disadvantage is possible interference between the intermediate roller and the side support rollers during control system malfunctions.

BRIEF SUMMARY OF THE INVENTION

An object of the present invention is to propose a roll stand and a method for operating a roll stand making it possible to solve the above mentioned problems.

This involves in particular proposing a roll stand of the sexto type supported laterally, including intermediate rollers capable of being moved axially, i.e. along their longitudinal axis of rotation, and of being subjected to cambering loads applied by camber blocks, and making it possible to:

- avoid relative axial movements between the working rollers and their side bearing units during operations of axial movement of the intermediate rollers and thus avoid axial loads on axial thrust bearings of the working rollers and surface degradations of said rollers
- avoid interferences between working rollers, side bearing units and intermediate rollers, said interference being associated with vertical movements of the working rollers and side bearing rollers during the phases of opening the roll stand in stand-by position and closing in working position.

With this object, a roll stand and a method for operating a roll stand are proposed by the content of the independent claims. A set of sub-claims also presents advantages of the invention.

On the basis of a roll stand for a strip to be rolled, said roll stand including two working rollers capable of gripping said strip to be rolled, more precisely, an upper working roller located above a plane of travel of the strip to be rolled, and a lower working roller located below said plane of travel of the strip to be rolled, the upper and lower working rollers having their longitudinal axes of rotation in a gripping plane perceptibly perpendicular to the plane of travel of the strip to be rolled, two intermediate rollers, respectively an upper intermediate roller capable of being in contact with the upper working roller and a lower intermediate roller capable of being in contact with the lower working roller, two bearing rollers, respectively an upper bearing roller capable of being in contact with the upper intermediate roller, and a lower bearing roller capable of being in contact with the lower intermediate roller, the upper and lower bearing rollers being capable of transmitting a gripping force to the working rollers by means of the intermediate rollers, or in other words, the roll stand includes six rollers stacked vertically according to a sexto roll stand configuration, also including at least one side bearing unit capable of laterally supporting one of said working rollers, in particular a first and a second upper side bearing unit, respectively positioned on each side of said gripping plane and capable of laterally supporting said upper working roller, and a first and a second lower bearing unit, positioned on each side of said gripping plane and capable of laterally supporting the lower working roller, the roll stand according to the invention is characterized in that it includes at least one camber block for cambering said intermediate rollers, said camber block being capable of vertical movement relative to posts of the roll stand and of supporting said side bearing unit.

On the basis of a method for operating a roll stand for a strip to be rolled, said roll stand including two working rollers capable of gripping said strip to be rolled, two intermediate rollers, two bearing rollers or, in other words, six rollers stacked vertically according to a sexto roll stand configuration, also including at least one side bearing unit capable of laterally supporting one of said working rollers, the method for operating the roll stand according to the invention is characterized by adjustable positioning of the side bearing unit providing for:

- first, holding the side bearing unit fixed relative to the working roller capable of being supported by said side bearing unit during axial movement of the intermediate roller, said intermediate roller being capable of being in contact with said working roller capable of being supported by said side bearing unit;
- second, holding the side bearing unit fixed relative to the intermediate roller during its vertical movements, said intermediate roller being capable of being in contact with the working roller capable of being supported by said side bearing unit;
- and third, holding the side bearing unit fixed relative to the roll stand during dismantling of said intermediate rollers.

The roll stand includes in particular at least two posts capable of providing vertical guidance of the bearing rollers and the intermediate rollers, said two posts not in particular being intended to support directly or indirectly the intermediate rollers and/or the side bearing units, but only to guide the bearing rollers and the intermediate rollers in a substantially vertical plane (i.e. substantially perpendicular to the plane of travel of the strip).

Also, said camber block of the roll stand according to the invention includes in particular a guide device integrated with said camber block and capable of supporting and guiding said side bearing unit. In particular, each of the camber blocks of said roll stand is capable of including said guide device capable of guiding and acting as a support for at least one of said side bearing units, such that, for example, camber blocks supporting a single side bearing unit each include said guide device, the latter being capable of guiding and supporting for example a support arm of said side bearing unit. Also, the guide device according to the invention provides in particular for pivoting about an axis of rotation of said guide device or sliding along a path predefined by said guide device of said side bearing unit. Thus, said side bearing unit is in particular capable of pivoting about an axis of rotation of said guide device integrated with said camber block or sliding along a path defined by the guide device. Furthermore, each camber block of the roll stand according to the invention is capable of supporting at least one chock of an intermediate roller and also axial movement of the latter. It is in particular not only capable of acting as a support for said chock, but it is also intended to support an axial movement, for example by sliding, of said chock.

Also, the roll stand is in particular advantageously characterized by actuators capable of moving said camber blocks vertically. In fact, each camber block of the roll stand according to the invention is in particular capable of being moved vertically by means of at least one of said actuators. According to a particular configuration, eight camber blocks separated from one another, for example hydraulic camber blocks, are capable of supporting the chocks of the upper and lower intermediate rollers, respectively four upper camber blocks capable of supporting the chocks of the upper intermediate roller and four lower camber blocks capable of supporting the chocks of the lower intermediate roller. Of the four upper camber blocks, two camber blocks positioned at one end of the intermediate roller, on each side of said gripping plane, are capable of acting as a support for a chock of said intermediate roller and the other two camber blocks positioned at the other end of said intermediate roller, on each side of said gripping plane, are capable of acting as a support for another chock of said intermediate roller. Similarly, the four lower camber blocks are each capable of acting as a support, by pair of two camber blocks, for a chock of the lower intermediate roller. The eight camber blocks are able advantageously to be moved vertically relative to the posts of the roll stand, in a synchronized manner in groups of four, in particular a first group of four synchronized upper blocks and a second group of four synchronized lower blocks, are each able to be moved vertically, in a synchronized manner, by means of at least one actuator, for example a mechanical or hydraulic actuator, in particular capable of being placed between an upper camber block and a lower camber block. Thus, at least one actuator is advantageously capable of moving an upper camber block vertically relative to a lower camber block, said upper and lower camber blocks being placed on each side of the plane of travel of the strip and close to a single end of a working roller.

According to an advantageous characteristic of the roll stand according to the invention, each chock of an intermediate roller includes in particular two protuberances intended to slide axially with slight play in the chock guide housings placed in each of the camber blocks. Said protuberances are for example each positioned on a lateral face of the chock so that the latter is capable of being supported by the camber blocks positioned on each side of the gripping plane. Advantageously, said protuberances are capable of allowing the chock to slide in said chock guide housings of the camber blocks in a direction parallel to the longitudinal axis of rotation of the intermediate roller. In particular, axial movement units are capable of moving said intermediate rollers axially by moving the chocks of said intermediate rollers relative to the camber blocks. Thus, the roll stand according to the invention is characterized by an intermediate roller seating device including a part fixed axially relative to the roll stand, in particular the camber blocks, and a part axially mobile relative to said roll stand, in particular the chocks of each of said intermediate rollers.

Each of the upper and lower working rollers can therefore by supported/held laterally, on each side of the gripping plane, by side bearing units which are positionally adjustable but axially fixed relative to the roll stand (the term axially referring to the axial direction defined by the longitudinal axis of rotation of the working or intermediate rollers).

Advantageously, the constructional arrangements described above allow the side bearing unit guide devices to remain axially fixed relative to the working rollers during axial movement of the intermediate rollers, or more precisely, during axial movement of the chocks supporting an intermediate roller. In fact, each of the working rollers does not include a chock, but is blocked axially at each of its ends by axial thrust bearings capable of holding said working roller in a position which is axially constant or fixed relative to the roll stand during rolling of a strip to be rolled. The camber blocks, integrated with the side bearing unit guide devices which they support, are axially fixed relative to this same stand. It follows that, given the operating play, in particular the play between the ends of the working rollers and their axial thrust bearings, the side bearing units are capable of remaining axially fixed relative to the working rollers during rolling. This axial fixing does not prevent each of the side bearing units from moving radially relative to the working rollers, in particular by sliding in sliding type guide devices, or by pivoting about a center or axis of rotation of a rotary type guide device. In other words, the side bearing units are capable of moving in directions included in a plane perceptibly perpendicular to the plane of travel of the strip to be rolled and perceptibly perpendicular to the axial direction defined by a longitudinal axis of rotation of an intermediate or working roller.

Advantageously, these same constructional arrangements also allow the side bearing unit guide devices to remain fixed relative to the intermediate rollers during vertical movement of them, given that, during vertical movement of a camber block, the side bearing units and the chocks of the intermediate roller are moved simultaneously with said camber block supporting them. It follows that each side bearing unit is capable of following the vertical movement of the working roller it supports, while retaining the capacity to move radially relative to these same working rollers.

Finally, these same constructional arrangements allow each of the side bearing units guide devices to remain advantageously fixed relative to the roll stand during removal of the intermediate rollers from said roll stand. In fact, each side bearing unit supported by at least one of said guide devices integrated with a camber block is capable of remaining axially fixed relative to the roll stand during extraction from the roll stand of an intermediate roller supported by the same camber block. Thus, dismantling of the side bearing units is unnecessary during extraction of an intermediate roller and the constructional arrangements of the roll stand according to the invention allow said side bearing units to be held in place in the roll stand during extraction of the intermediate rollers, independently of their capacity to move radially relative to the working rollers.

In particular, the roll stand according to the invention includes at least one means of movement of one or more side bearing units capable of moving and positioning said side bearing unit or said side bearing units. Also, said means of movement are in particular capable of being guided by a guide unit directly or indirectly integrated with the posts of the roll stand. In particular, said means of movement include at least one thrust unit, for example a movement actuator, mechanical or hydraulic, guided by at least one guide unit directly or indirectly integrated with one or more posts of the roll stand and capable of moving a side bearing unit radially relative to the working roller which it is capable of supporting. The movement actuators are capable of synchronously moving ends of the side bearing units, said ends being in particular intended to support one of said working rollers. Said movement actuator is for example a screw and nut device or a wheel and worm screw device or a wedge device actuating the side bearing units, directly or through a thrust load distribution beam. Generally, the roll stand according to the invention is in particular characterized in that two thrust units which can be actuated in a synchronized manner by a screw device are each capable of acting synchronously on an end of one of said side bearing units with a view to positioning it or, according to another configuration, two thrust units which can be actuated in a synchronized manner by a wedge device are each capable of acting synchronously on an end of one of said side bearing units with a view to positioning it. In both cases, a thrust load distribution beam can be inserted between the side bearing unit and at least one of its thrust units. In particular, the thrust load distribution beam is able to be inserted between a support arm of the side bearing unit and its thrust unit or units.

Moreover, the roll stand according to the invention includes at least one movement unit for an intermediate roller which can for example be a movement actuator, mechanical or hydraulic, of said intermediate roller. In particular, each movement actuator for an intermediate roller is capable of being guided by a guide device of the intermediate roller directly or indirectly integrated with one or more posts of the roll stand and of moving said intermediate roller axially. Each of the guide devices of the intermediate rollers permits vertical movement of the chocks of the intermediate rollers appropriate to the vertical movement of the camber blocks supporting said chocks of the intermediate rollers.

Advantageously, unlike roll stands characterized by axial movement of the spindles of the intermediate rollers relative to their bearings so as to provide for the axial movement of the intermediate rollers and requiring spindles formed from a surface made from an extremely strong material, the present invention makes it possible for the chocks of the intermediate rollers to move axially by sliding in the chock guide housings placed in the hydraulic camber blocks and thus avoid any relative movement of the spindles relative to their bearings, on the contrary allowing the spindles to be fixed relative to their bearings. It is then possible to use standard bearings with a high load capacity, for example bearings with four rows of wheels mounted in TQO configuration. Advantageously, the fixing of the spindles relative to their bearings makes it possible to choose the latter from a range of sealed bearings, i.e. intrinsically sealed or assembled/mounted in a sealed manner in their chocks. The roll stand according to the invention is thus in particular characterized in that each of said intermediate rollers includes at each of its ends a spindle capable of being fitted with a bearing with high radial and axial load capacity, said bearing being capable of being mounted in each of the chocks of said intermediate rollers.

Furthermore and in particular, the roll stand according to the invention is characterized in that said side bearing unit includes a side support roller and its bearing wheels. Also, particularly advantageously, said side bearing unit according to the invention may include in particular at least one support arm capable of supporting said side support roller and its wheels, said support arm being able in particular to be used as a dismantling rail or rail support on which the dismantling wheels or runners fitted to the chocks of the intermediate rollers can roll. Thus, each side bearing unit is capable of including a dismantling rail capable of being used to dismantle an intermediate roller. In particular, the side bearing units positioned on each side of the gripping plane and supporting the same working roller each include said dismantling rail providing for dismantling the intermediate roller capable of being in contact with said working roller, i.e. its removal from the stand, in particular by sliding the runners or rolling the wheels fitted to the chocks of said intermediate roller on or in said rail.

Also, the roll stand according to the invention is in particular capable of including at least one oil distribution unit capable of being mounted on at least one side bearing unit support arm, making it possible in particular to supply fluid to buses capable of lubricating the strip and/or the working rollers, or other rollers used in rolling. Advantageously, given that the side bearing units are integrated with the camber blocks and not the chocks of the intermediate rollers and are also capable of remaining in the roll stand during extraction/dismantling and reassembly of said intermediate rollers, it is not necessary, as in EP 0 937 517, to make use of automatic coupling systems for the pipework supplying lubricant oil to the rollers and wheels of the side bearing units. According to the present invention, the oil distribution units can be mounted on the support arms of the side bearing units and supplied by flexible pipes which can be connected to supply points fixed to posts of the roll stand and providing for radial adjustment movements of the side bearing units relative to the working rollers.

According to one variant, the roll stand according to the invention is in particular characterized in that a shim can be positioned by means of a jack between an end of a side bearing unit and one of said thrust units, said shim being capable of being retracted. In particular, two shims are each able to be positioned in a synchronized manner between a thrust unit and a side bearing unit. They advantageously provide for rapid dismantling of an intermediate roller by retracting said shims, said retraction resulting in the rapid removal of the side bearing units from the working rollers they are capable of supporting.

Finally, according to a particular configuration of the roll stand according to the invention, the latter includes eight separate hydraulic camber blocks supporting the chocks of the upper and lower intermediate rollers, respectively four upper camber blocks supporting the two chocks of the upper intermediate roller and four lower camber blocks supporting the two chocks of the lower intermediate roller, said camber blocks being capable of cooperating with mechanical or hydraulic actuators arranged between each pair of upper and lower camber blocks and providing for vertical movement of said camber blocks relative to the posts of the roll stand in groups of four, a first group of four synchronized upper blocks and a second group of four synchronized lower blocks, said eight camber blocks also including chock guide housings in which one of the two protuberances positioned on each of the two lateral faces of the chocks are capable of sliding or running axially, said protuberances making said chocks capable of running axially with slight play in the chock guide housings placed in each of the eight hydraulic camber blocks, and two guide devices for each of the side bearing units of each of the upper and lower working rollers, respectively a first guide device integrated with a first camber block, and a second guide device integrated with a second camber block, the first and the second camber blocks supporting the same side bearing unit.

In order better to understand the present invention, exemplary embodiments and applications are provided with the aid of the following figures:

DESCRIPTION OF THE INVENTION

Figure 1:
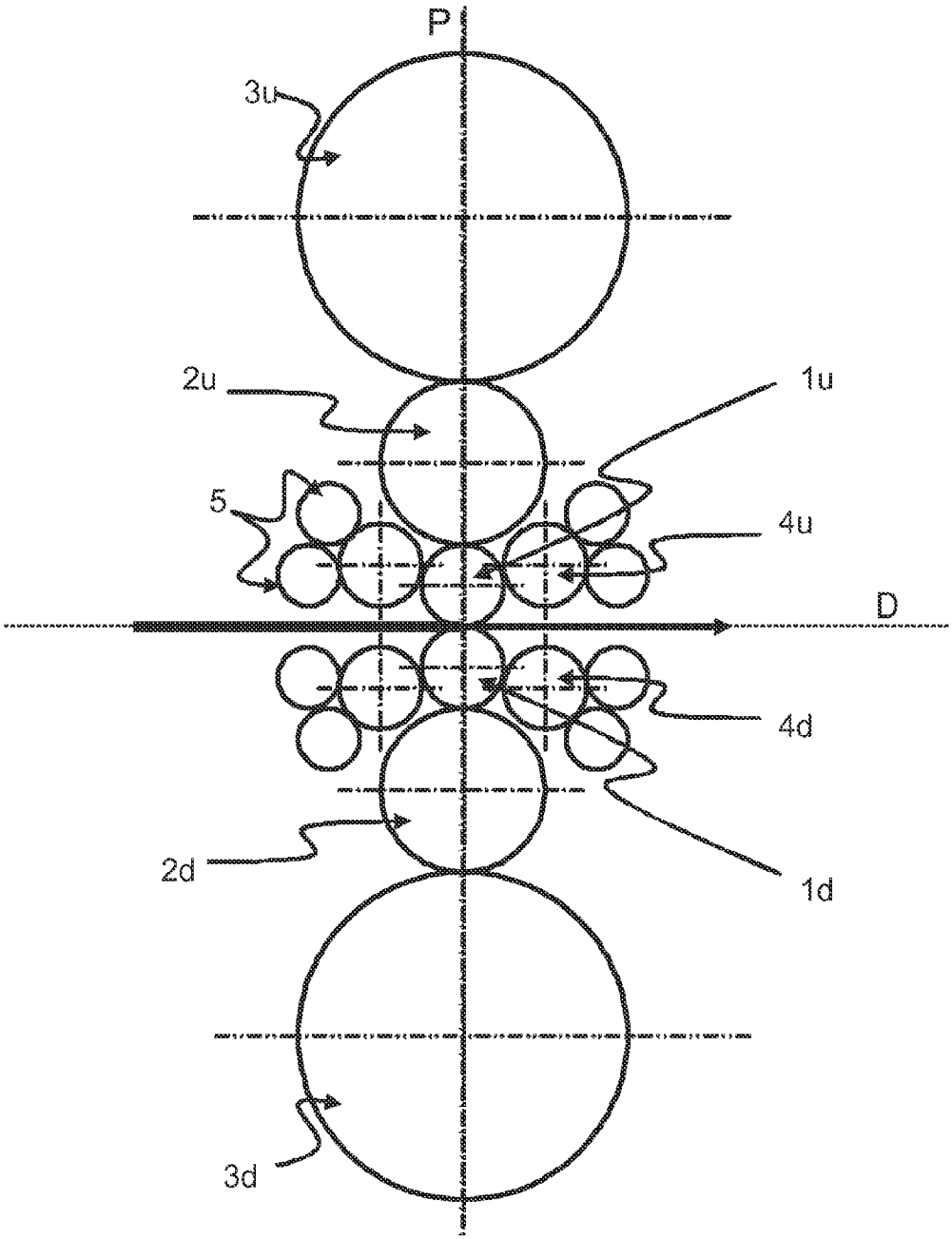
FIG 1 PRIOR ART
FIG. 1 exemplary embodiment of a sexto roll stand supported laterally according to the prior art.

FIG. 1 shows an exemplary embodiment of a sexto roll stand supported laterally according to the prior art. Traditionally, a sexto roll stand includes two working rollers 1*u*, 1*d* of small diameter, respectively an upper working roller 1*u* positioned above a plane of travel D of a strip to be rolled, and a lower working roller 1*d* positioned below said plane of travel D of the strip to be rolled. Said strip to be rolled travels between the two working rollers 1*u*, 1*d* supported vertically, and in particular driven by friction, by a pair of intermediate rollers 2*u*, 2*d*, themselves supported vertically by a pair of bearing rollers 3*u*, 3*d* resting on said pair of intermediate rollers 2*u*, 2*d*. The working rollers 1*u*, 1*d* have their longitudinal axis of rotation in a plane perceptibly perpendicular to the plane of travel of the strip, and commonly called the gripping plane P. In the case of lateral support, each working roller is not only supported, on the one hand, vertically by the two intermediate rollers 2*u*, 2*d*, i.e. respectively the upper intermediate roller 2*u* and the lower intermediate roller 2*d*, themselves supported by the two vertical bearing rollers 3*u*, 3*d*, i.e. respectively the upper bearing roller 3*u* and the lower bearing roller 3*d*, but also, on the other hand, each working roller 1*u*, 1*d* is supported laterally by side bearing units each including in particular a side support roller 4*u*, 4*d*, supported by two rows of bearing wheels 5 mounted side by side. Thus, two side support rollers arranged symmetrically on each side of the working roller are capable of laterally supporting said working roller. Furthermore, each row of bearing wheels 5 is made up of a plurality of wheels arranged side by side along a common axis on a support arm common to two rows.

Figure 2:
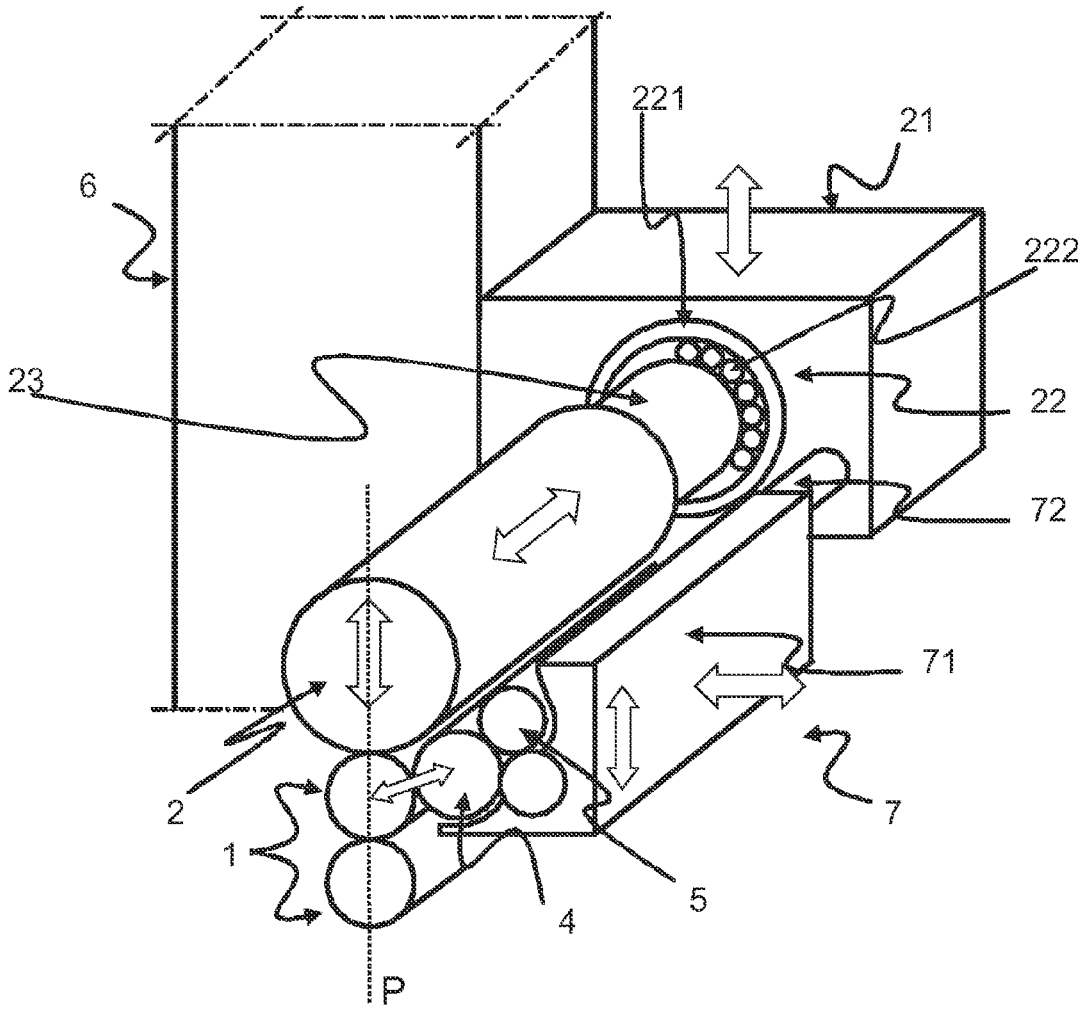
FIG 2 PRIOR ART
FIG. 2 exemplary embodiment of a side bearing unit integrated with axially fixed chocks of an intermediate roller according to the prior art.

FIG. 2 describes an exemplary embodiment of a side bearing unit 7 of a sexto roll stand according to the prior art, said side bearing unit 7 being integrated with chocks 21 of an intermediate roller 2. Said chocks 21 are axially fixed relative to the posts 6 of the roll stand. The intermediate roller 2, in particular an upper intermediate roller as presented in FIG. 2, is supported at each of its ends by one of said chocks 21 axially fixed relative to the posts 6 of the roll stand, but capable of vertical movements between these same posts. Rotational guidance of the intermediate roller 2 in its chock is provided by a bearing 22 including in particular an outer ring 221 and cylindrical rollers 222. Durant axial movement of the intermediate roller 2, a spindle 23 of said intermediate roller is capable of sliding axially on the cylindrical rollers 222.

Two side bearing units 7, only one of which is shown here, are positioned on each side of a gripping plane P which may include in particular the axes of longitudinal rotation of the working rollers 1 in order laterally to support the working roller 1 with which they are in contact. Each side bearing unit 7 includes in particular a support arm 71 capable of carrying both a side support roller 4 and its support wheels 5. Thus, two side support rollers 4, only one of which is shown, are positioned on each side of the gripping plane P. Each pair of side support rollers 4 is capable of laterally supporting one of said working rollers 1. Each side support roller is itself supported by two rows of wheels 5. The side bearing unit 7 is also capable of pivoting about a guide unit 72 integrated with the chock 21.

The constructional arrangement of the roll stand presented in FIG. 2 shows that it is impossible to undertake extraction and maintenance operations on intermediate rollers 2 without preventing, by means of specific tools, the pivoting of the side bearing units 7 about their guide unit 72. It also shows that it is impossible to grind the active face of the intermediate rollers 2 between two rolling runs without dismantling the chocks 21 and the two side bearing units 7 which they support.

Also, since the chocks 21 are axially fixed relative to the posts 6 of the roll stand, the side bearing units 7 are also fixed relative to said posts 6 of the roll stand and therefore relative to the working rollers 1. The axial movement of the intermediate roller 2 is therefore provided by axial sliding of its spindles 23 relative to the chock 21 and the bearing 22. For this purpose, the spindles 23 of the intermediate roller 2 have to be lengthened by a length corresponding to the distance of axial movement of the intermediate roller 2.

Figure 3:
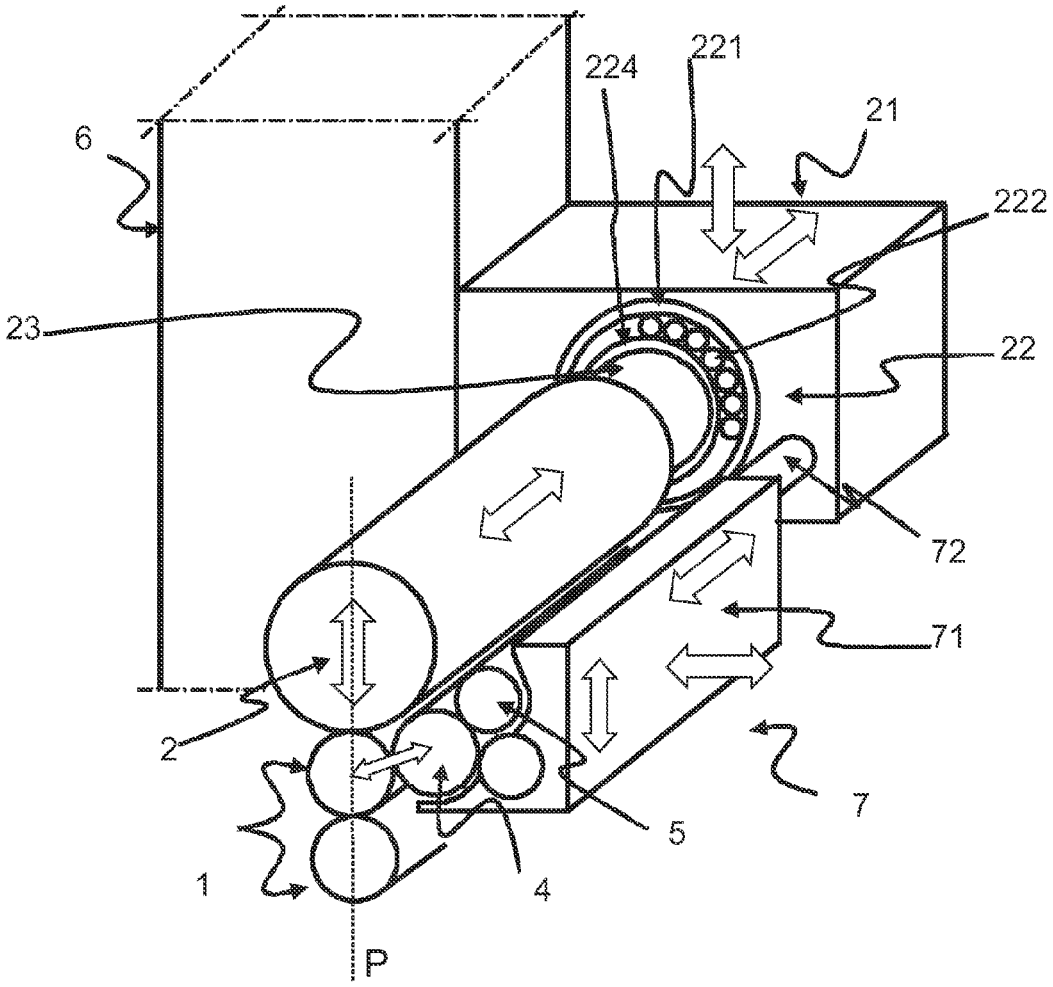
FIG 3 PRIOR ART
FIG. 3 exemplary embodiment of a side bearing unit integrated with axially mobile chocks of an intermediate roller according to the prior art.

FIG. 3 describes an exemplary embodiment according to the prior art of a side bearing unit 7 of a sexto roll stand, said side bearing unit 7 being integrated with the chocks 21 of an intermediate roller 2. Unlike the roll stand described in FIG. 2, said chocks 21 are axially mobile relative to the posts 6 of the roll stand. In fact, said chocks 21 can be moved axially and vertically relative to the posts 6 of the roll stand, while still being capable of supporting the intermediate roller 2 and the side bearing units 7 which they support.

In particular, the intermediate roller 2, in particular an upper intermediate roller as presented in FIG. 3, is capable of being supported at each of its ends by said chock 21 which is axially mobile relative to the posts 6 of the roll stand and capable of vertical movement between these same posts 6. A bearing 22 made up of an outer ring 221, an inner ring 224 and wheels 222 is capable of rotationally guiding the intermediate roller 2 in its chock. During axial movement of the intermediate roller 2, the chocks 21 of said intermediate roller are capable of moving synchronously with said intermediate roller, while the spindles 23 of said intermediate roller are capable of remaining fixed relative to the bearings 22.

The working roller 1 is supported laterally on two side support rollers 4, only one of which is shown. Each side support roller is supported by two rows of wheels 5. A side bearing unit 7 includes in particular a support arm 71 capable of carrying both the side support rollers 4 and the wheels 5. This side bearing unit 7 is also capable of pivoting about a guide unit 72 integrated with the chock 21 and accompanying the chock 21 during its axial movement.

According to the constructional arrangement presented in FIG. 3, the chocks 21 are axially mobile relative to the posts 6 of the roll stand and synchronously accompany the axial movement of the intermediate roller. Consequently, the side bearing units 7 are capable of moving relative to the working roller 1, which itself remains axially fixed between axial thrust bearings (not shown), which are themselves, during rolling, axially fixed relative to the posts 6 of the roll stand.

Figure 4:
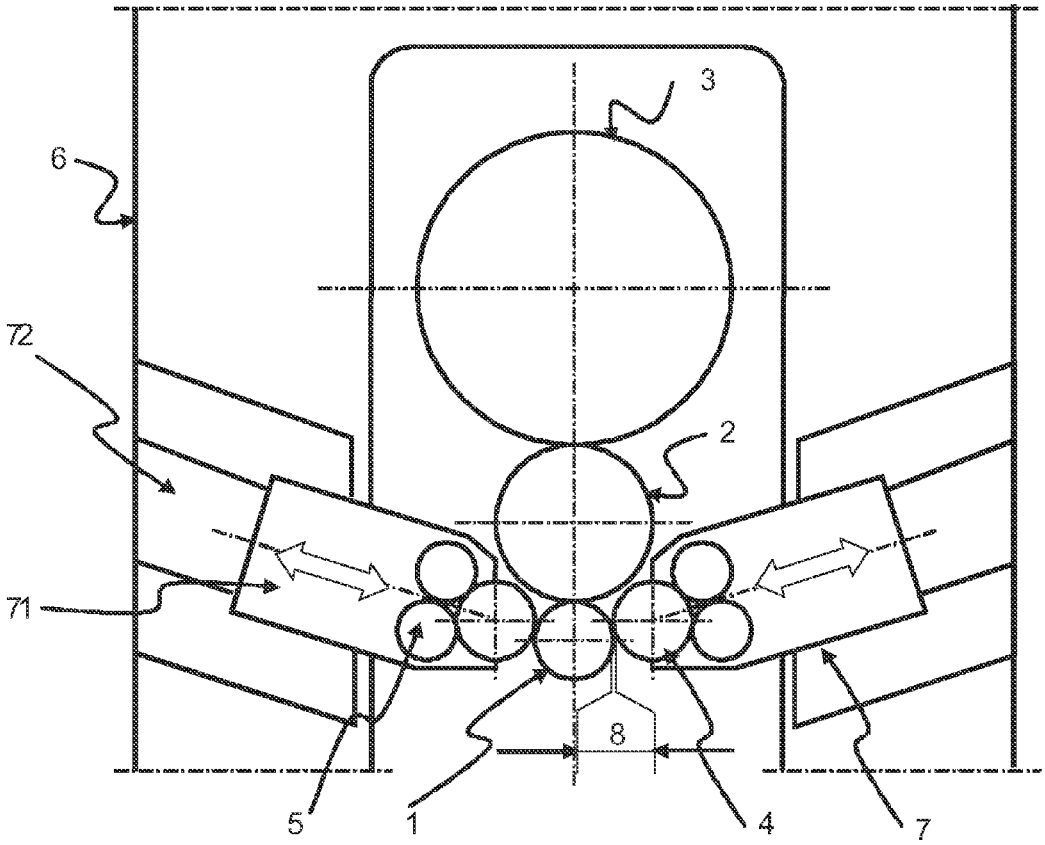
FIG 4 PRIOR ART
FIG. 4 exemplary embodiment of side bearing units integrated with posts of a roll stand according to the prior art.

FIG. 4 shows an exemplary embodiment of side bearing units 7 of a roll stand according to the prior art, said side bearing units 7 being integrated with the posts 6 of the roll stand. The roll stand is fitted with two working rollers 1, each supported, on the one hand, vertically by two intermediate rollers 2, and, on the other hand, laterally by two side support rollers 4, themselves supported by two rows of bearing wheels 5 mounted side by side. In particular, each of said intermediate rollers 2 is itself supported by a vertical bearing roller 3. Under the action of a mechanical or hydraulic actuator (not shown), a support arm 71 capable of carrying both a side support roller 4 and its wheels 5 is capable of sliding in a guide device 72 integrated with the post 6 of the roll stand. In the case of vertical movement of the working roller 1, for example a vertical movement of an upper working roller in the direction of the upper bearing roller, interference 8 may take place between the working roller 1 and at least one of the two side support rollers 4. In other words, the working roller 1 is capable of interfering with a side support roller 4, for example by contacting the latter, during a vertical movement of said working roller 1.

Figure 5:
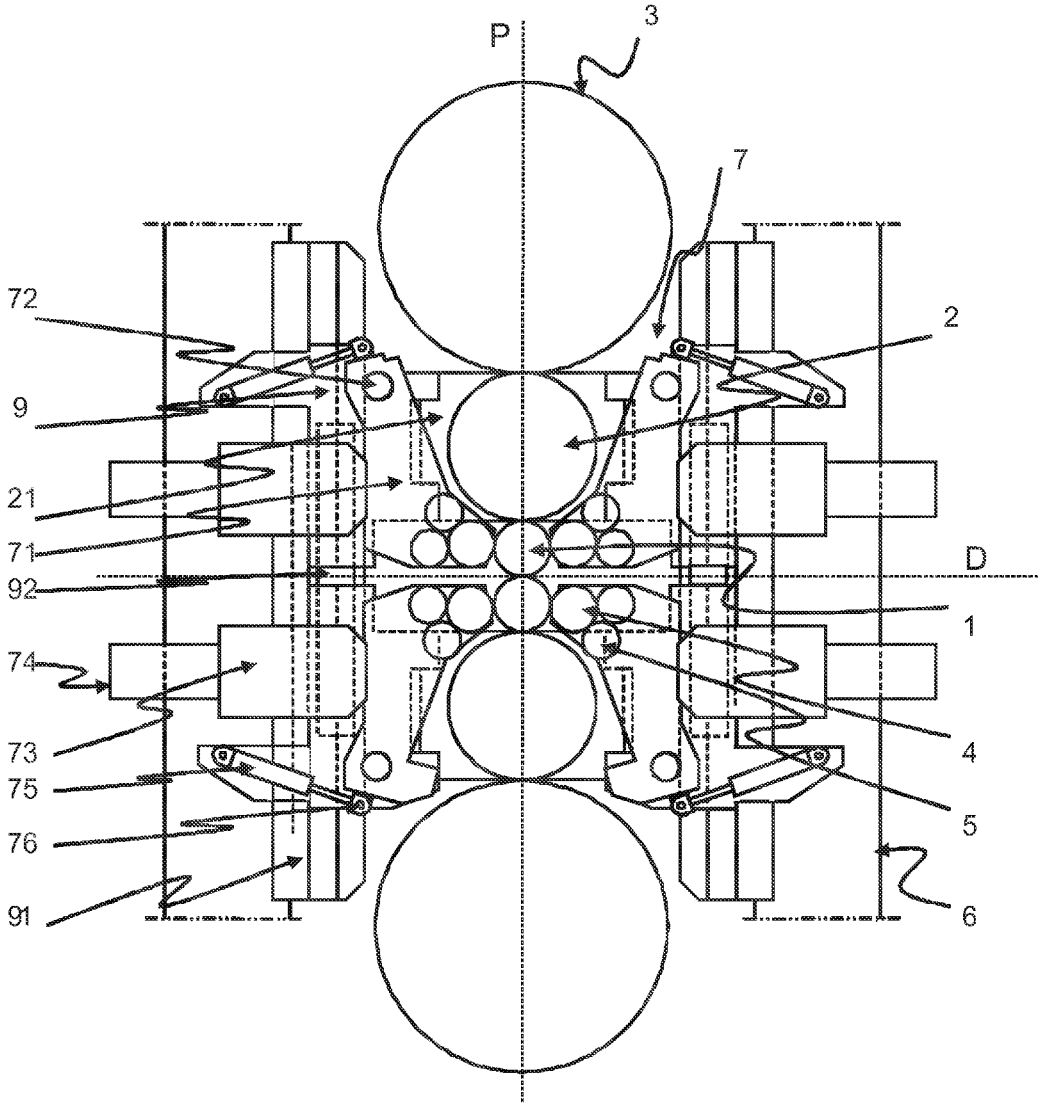
FIG. 5 exemplary embodiment of a roll stand according to the invention.

FIG. 5 shows an exemplary embodiment of a roll stand according to the invention. In particular, the roll stand includes two working rollers 1 capable of gripping a strip to be rolled, more precisely, an upper working roller positioned above a plane of travel D of the strip to be rolled, and a lower working roller positioned below said plane of travel D of the strip to be rolled, the upper and lower working rollers 1 having their longitudinal axes of rotation in a gripping plane P perceptibly perpendicular to the plane of travel D of the strip to be rolled, two intermediate rollers 2, respectively an upper intermediate roller capable of being in contact with the upper working roller and a lower intermediate roller capable of being in contact with the lower working roller, two bearing rollers 3, respectively an upper bearing roller capable of being in contact with the upper intermediate roller and a lower bearing roller capable of being in contact with the lower intermediate roller, the upper and lower bearing rollers being capable of transmitting a gripping force to the working rollers 1 through the intermediate rollers, or in other words, the roll stand includes six rollers stacked vertically according to a sexto roll stand configuration and also includes at least one side bearing unit 7 capable of laterally supporting one of said working rollers 1, in particular a first and a second upper side bearing unit, positioned respectively on each side of said gripping plane and capable of laterally supporting said upper working roller 1, and a first and a second lower side bearing unit, positioned on each side of said gripping plane and capable of laterally supporting the lower working roller 1, the roll stand according to the invention is characterized in that it includes at least one camber block 9 intended to camber said intermediate rollers 2, said camber block 9 being capable of being moved vertically relative to the posts 6 of the roll stand and of supporting said side bearing unit 7. In particular, said camber block 9 is also advantageously capable of supporting the axial movement of at least one chock 21 of intermediate rollers 2 and of being used to camber at least one of said intermediate rollers 2. Thus, the roll stand according to the invention includes in particular at least one camber block 9 capable of moving vertically relative to the posts 6 of the roll stand, while still, acting as a support for said side bearing unit 7, to at least one chock 21 of an intermediate roller 2, and allowing the axial movement of said chock 21 relative to the posts 6 of the roll stand and therefore of the intermediate roller 2 it supports.

The constructional arrangements described by FIG. 5 allow the side bearing units 7 to remain axially fixed relative to the working rollers during axial movement of the intermediate rollers, to remain fixed relative to the intermediate rollers during vertical movement of said intermediate rollers, to remain fixed relative to the roll stand during removal of the intermediate rollers from said cage and, in all circumstances, said constructional arrangements according to the invention allow the side bearing units to remain radially adjustable relative to the working rollers.

In particular, each of said side bearing units 7 includes a support arm 71 capable of carrying a side support roller 4 and bearing wheels 5. The side bearing units are in particular capable of laterally supporting said working rollers 1 by means of said side support rollers 4. Each of the latter is capable of laterally contacting said working rollers in order to maintain the working roller 1 in a perceptibly constant lateral position or according to a designated position. In fact, each side of one of said working rollers 1 is capable of being supported, by resting against one of its generating lines, by one of said side support rollers, thus distributed on each side of said gripping plane P. In particular, said side support rollers 4 are also themselves supported laterally by two rows of said bearing wheels mounted side by side.

In particular, the intermediate rollers 2 are capable of being supported at each of their ends by said chock 21 axially mobile relative to the posts 6 of the roll stand, said mobility of the chock resulting for example from sliding of parts of said chock 21 on parts of the camber blocks 9 provided for the purpose.

Figure 6:
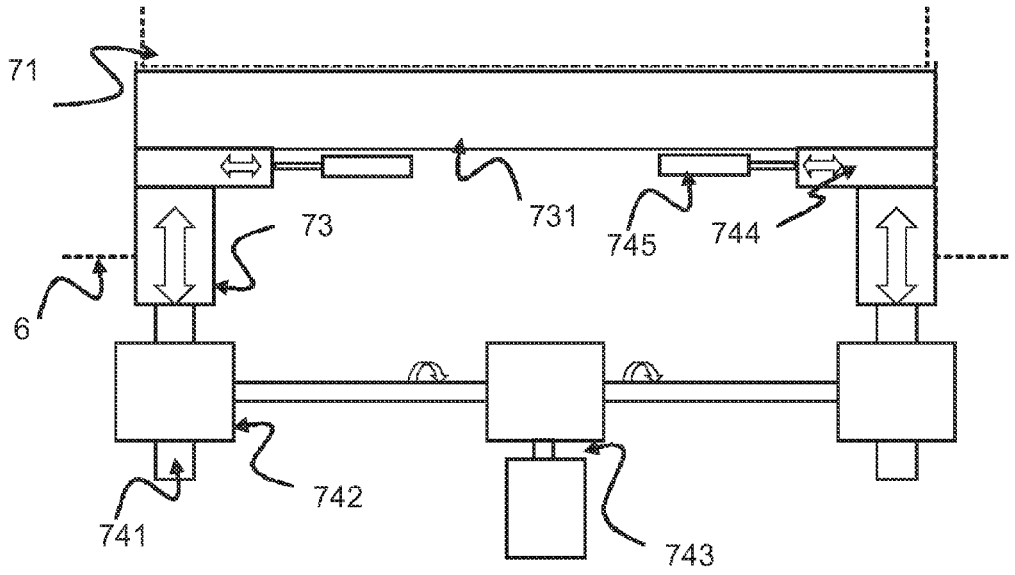
FIG. 6 example of a first embodiment of means of movement of side bearing units according to the invention.
Figure 7:
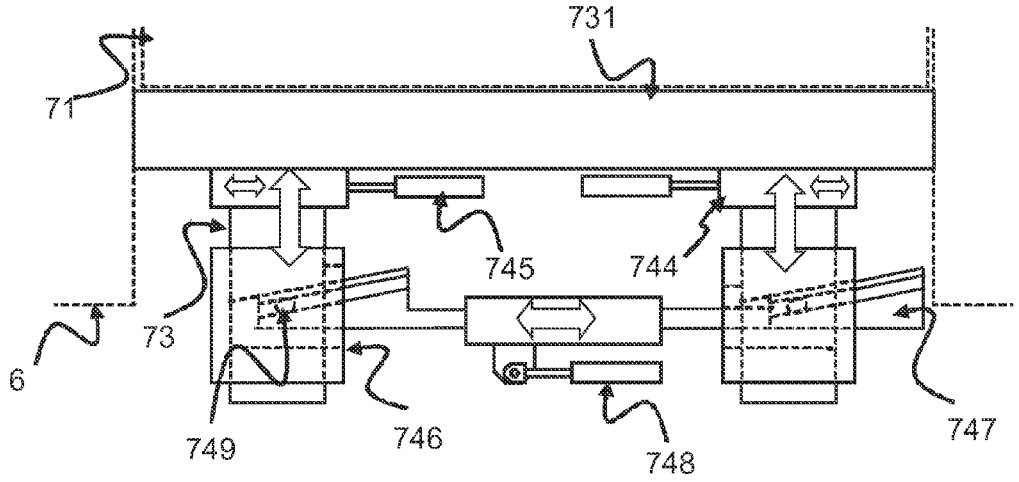
FIG. 7 example of a second embodiment of means of movement of side bearing units according to the invention.

Each side bearing unit is in particular capable of pivoting about a guide device 72, or more precisely, about an axis of rotation of a guide device 72 integrated with one of said camber blocks 9, or of sliding in a direction or along a path defined by said guide unit 72. In particular, a side bearing unit movement means, including for example a thrust unit 73, is capable of making said side bearing unit pivot about said guide device 72, in particular about its axis of rotation. In particular, the support arm 71 of said side bearing unit is capable of pivoting about said guide device 72, in particular under the action of said thrust unit 73 capable of taking up the radial loads absorbed by the working rollers 1 during rolling. In order to provide for the proper take-up of these radial loads by limiting the risks of flexion of the support arm 71, a high-inertia load distribution beam 731 can be inserted between the thrust units 73 and said support arm 71 in order to distribute the reactions of the thrust units 73 over the entire length of the support arm 71. FIGS. 6 and 7 show an example of installation of such a load distribution beam 731.

Each of the thrust units 73 of said movement means can in particular be actuated by at least one screw or wedge actuator 74 capable in particular of actuating in a synchronized manner at least two thrust units 73, each positioned at a longitudinal end of the side bearing unit, said longitudinal end referring in particular to each of the two ends of the side bearing unit 7 according to the width of the strip. A jack 75 is in particular capable of acting, i.e. exerting force, between a camber block 9 and a point of articulation 76 of a side bearing unit 7 supported by the guide device of said camber block in order to provide for the pivoting of said side bearing unit about an axis of rotation of said guide device 72 integrated with said camber block 9. Advantageously, said pivoting allows for positioning said side bearing units when the thrust units are in retracted position. In particular, a support arm 71 of a side bearing unit 7 includes said point of articulation 76. In this case, said jack 75 is for example a hydraulic jack integrated with one of said camber blocks and capable of making said support arm 71 including said point of articulation 76 pivot about said axis of rotation of the guide device 72.

Also, each camber block 9 is in particular capable of being moved vertically by an actuator 92, placed in particular between the camber blocks 9 of a pair of camber blocks including an upper camber block and a lower camber block, said upper and lower camber blocks being distributed on each side of the plane of travel of the strip to be rolled, close to the same end of a working roller 1. Thus, the roll stand according to the invention includes in particular hydraulic actuators 92 capable of providing for vertical movement of said camber blocks 9 relative to the posts 6 of the roll stand. In particular, four hydraulic actuators 92 can be placed between a first group of four upper camber blocks and a second group of four lower camber blocks, each of said actuators being capable of vertically moving the camber blocks of a pair of camber blocks 9 including an upper camber block and a lower camber block. For this purpose, a hydraulic actuator 92 can be placed between the camber blocks of each pair of camber blocks in order vertically to move in a synchronized manner groups of four camber blocks 9 relative to the posts 6 of the roll stand, in particular said first group of four upper camber blocks which can be moved in a synchronized manner by their hydraulic actuators and said second group of four lower blocks which can be moved in a synchronized manner by their hydraulic actuators. In particular, the camber blocks 9 are capable of moving vertically on supports of the camber blocks 91 integrated with the posts 6 of the roll stand.

FIG. 6 presents a first exemplary embodiment according to the invention of a means of moving side bearing units, including in particular two thrust units 73. In particular, the support arm 71 of the side bearing unit is capable of being pushed by the two thrust units 73. These latter are capable of being guided on the posts 6 of the roll stand and/or on camber block supports integrated with said posts and of acting in a synchronized manner. These thrust units can in particular each be actuated by a screw 741 fixed in rotation and capable of axially moving said thrust unit 73 in a reversible manner under the action of a wheel and worm screw unit or a bevel gear unit 742. The bevel gear unit 742 can in particular be actuated by a motor drive 743. Shims 744 capable of being retracted and actuated by jacks 745 allow in particular the rapid release of the support arm 71 of a side bearing unit. Each of said shims can in particular be positioned between said thrust unit and said support arm 71. Advantageously, a high-inertia load distribution beam 731 can in particular be inserted between the thrust units 73 and the support arm 71 in order to distribute the thrust loads over the entire length of said support arm 71.

FIG. 7 presents a second example of a side bearing unit movement means according to the invention, including in particular two thrust units 73 capable of moving, in particular by thrust, the side bearing support arm 71. Each of said thrust units 73 is in particular capable of being guided on the posts 6 and/or camber block supports. These thrust units can in particular be actuated in a synchronized manner by two wedge boxes 746. In particular, under the action of a wedge ramp 747 which can be actuated by a jack 748, said thrust units 73 are in particular capable of moving axially. Advantageously, pins 749 which can be engaged in grooves parallel to the slope of the wedges allow in particular the reverse return of the thrust units 73 and provide for the return movement of said thrust units. Similarly to the constructional arrangements presented in FIG. 6, shims 744 capable of being retracted and actuated by jacks 745 provide in particular for the rapid release of the support arm 71 of a side bearing unit. Said shims can each in particular be positioned by means of said jacks 745 between said thrust unit and said support arm 71. Advantageously, a high-inertia load distribution beam 731 can in particular be inserted between the thrust units 73 and the support arm 71 in order to distribute the thrust loads over the entire length of said support arm 71.

Figure 8:
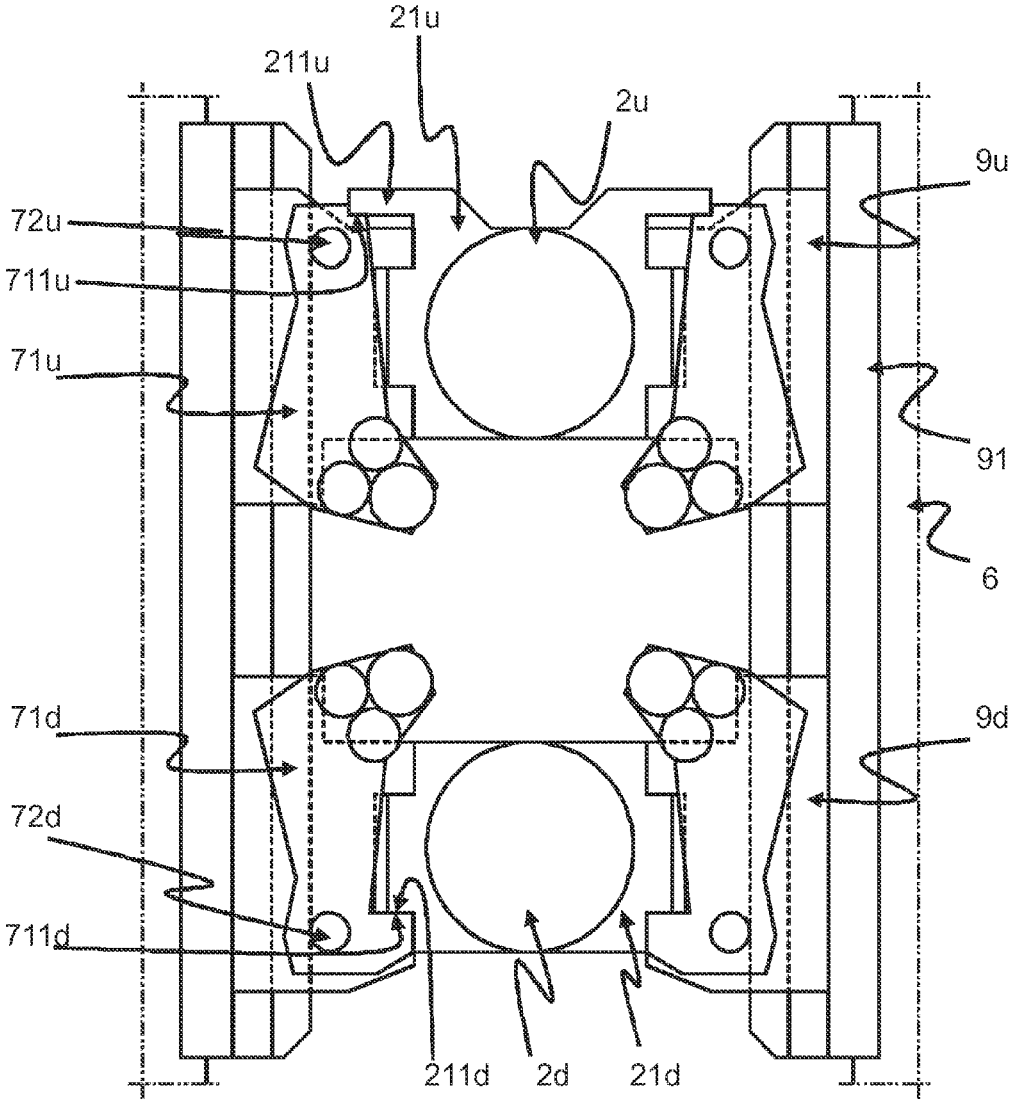
FIG. 8 example of use of side bearing units as intermediate roller dismantling rails according to the invention.

FIG. 8 presents an example of use of side bearing units 7 as rails for dismantling intermediate rollers 2 according to the invention. Upper 9*u* and lower 9*d* camber blocks can be separated in dismantling position by moving on camber block supports 91, said camber block supports 91 being integrated with posts 6 of the roll stand. In particular, each support arm 71 of each of said side bearing units is capable of being pivoted about an axis of rotation of the guide device 72 which supports it, in order to provide free passage of the upper 21*u* and lower 21*d* chocks, carrying respectively the upper intermediate roller 2*u* and the lower intermediate roller 2*d*.

Also, each of the upper support arms 71*u* of the upper side bearing units is capable of including in particular a sliding or rolling surface 711*u* capable of cooperating with castors or sliding runners (not shown) which can be fitted with wings 211*u* of the upper chocks 21*u*. Thus, in dismantling position, removal from the roll stand of an upper intermediate roller 2*u* carried by said upper chocks 21*u* capable of moving axially by sliding or rolling respectively said runners or said castors on said surfaces 711*u* can be carried out by axial movement of said chocks on the upper support arms 71*u* of the side bearing units to a dismantling trolley (not shown).

Similarly, each lower support arm 71*d* of the lower side bearing unit includes a sliding or rolling surface 711*d* allowing the lower chocks 21*d* to move axially by sliding or rolling by means respectively of sliding runners or castors (not shown) which can be fitted to the surfaces 211*d* of said lower chocks 21*d*, said sliding runners or castors being intended to cooperate with the sliding or rolling surfaces 711*d* to provide for removal of the lower intermediate roller 2*d* and its lower chocks 21*d* from the roll stand to a dismantling trolley.

In summary, the roll stand and the method for operating a roll stand according to the invention present several advantages relative to the existing operating methods and roll stands in that:

- the side bearing units remain axially fixed relative to the working rollers during the axial movement of the intermediate rollers, which significantly reduces the axial loads produced by the movement of said intermediate rollers on the axial thrust bearings of the working rollers and the friction produced by the side support rollers on the working rollers;
- the side bearing units remain fixed relative to the intermediate rollers during the vertical movement of the latter, which prevents any risk of degradation of the installation by interference between the working rollers and the lateral supports during phases of opening and closing the roll stand;
- the side bearing units remain fixed relative to the roll stand during the removal of the intermediate rollers from said cage, which makes it possible to undertake maintenance of the intermediate rollers as in a conventional 6-High stand or a 4-High stand, without special tools or any need to dismantle the chocks;
- they make the use of rapid or automatic connection units for lubrication circuits for the intermediate roller bearings obsolete during removal and reassembly of these rollers owing to the use of sealed bearings not requiring lubrication circuits;
- they allow the use of standard bearings with high load capacity for the intermediate rollers, which are less costly and far stronger than special bearings with no inner ring;
- they allow the use of sealed bearings for the intermediate rollers, providing for the use of rolling fluids selected independently of the needs of bearing lubrication;
- they are free from constraints associated with a surface material and a spindle geometry providing for the axial movement of said spindles of the intermediate rollers relative to their bearings. In fact, they do away with the need to use intermediate roller spindles of great length and specially hardened, which were previously used for the axial movement of the intermediate roller;
- they provide for axial movement of the intermediate rollers under loading with no sliding of the bearings relative to the spindles;

they make the use of rapid or automatic connection units for lubrication circuits for the side support rollers and the wheels supporting them obsolete owing to the fact that the support arms capable of supporting them remain in the roll stand during removal and reassembly of the intermediate rollers;

they make the use of rapid or automatic connection units for lubrication and cooling circuits for the rolled strip and the surface of the rolling rollers obsolete during removal and reassembly of the intermediate rollers when the lubrication fluid spray buses are fixed to the side bearing units;

they ensure that the side bearing units are fixed axially relative to the axial thrust bearings of the working rollers, while still retaining a capacity for radial movement of these side bearing units relative to said working rollers;

they ensure that the side bearing units are integrated relative to the chocks of the intermediate rollers in order that the side bearing units and intermediate rollers move vertically in a synchronous manner, while still retaining a capacity for radial movement of the side bearing units relative to the working rollers;

they guarantee that the side bearing units are fixed axially relative to the roll stand while still retaining a capacity for radial movement of these side bearing units relative to the working rollers and also still retaining their vertical movement synchronous with the support devices of the intermediate rollers;

they make it possible to simplify roller changing operations, in particular upper and lower intermediate and working roller assemblies.

The invention claimed is:

1. A roll stand, comprising:

posts;

two working rollers configured for gripping a strip to be rolled, two intermediate rollers, two bearing rollers, and at least one side bearing unit configured for laterally supporting one of said working rollers; and at least one camber block for cambering said intermediate rollers and mounted for vertical movement relative to said posts of the roll stand and supporting said side bearing unit.

2. The roll stand according to claim 1, wherein said camber block includes a guide device, integrated with said camber block and configured for supporting and guiding said side bearing unit.

3. The roll stand according to claim 2, wherein said side bearing unit is configured for pivoting about said guide device integrated with said camber block.

4. The roll stand according to claim 1, wherein said camber block is configured for supporting at least one chock of an intermediate roller and for enabling an axial movement thereof.

5. The roll stand according to claim 1, which comprises an actuator disposed for moving said camber block vertically.

6. The roll stand according to claim 5, which comprises a first group of four camber blocks capable of acting as a support for chocks of an upper intermediate roller and a second group of four camber blocks capable of acting as a support for chocks of a lower intermediate roller, wherein each said first and second group of four camber blocks is disposed to move vertically relative to said posts of the roll stand in a synchronized manner by way of said actuator.

7. The roll stand according to claim 6, which comprises axial movement units configured for moving said intermediate rollers axially by moving said chocks of said intermediate rollers relative to said camber blocks.

8. The roll stand according to claim 1, which comprises at least one movement means capable of moving and positioning said side bearing unit.

9. The roll stand according to claim 8, wherein said movement means includes at least one thrust unit.

10. The roll stand according to claim 9, wherein said at least one thrust unit is one of two thrust units that can be actuated in a synchronized manner by a screw device and said thrust units are capable of acting in a synchronized manner, each on one end of one of said side bearing units with a view to positioning said side bearing units.

11. The roll stand according to claim 10, which comprises a high-inertia thrust load distribution beam to be inserted between a side bearing unit and at least one of its thrust units.

12. The roll stand according to claim 9, wherein said at least one thrust unit is one of two thrust units that can be actuated in a synchronized manner by a wedge device and said thrust units are capable of acting in a synchronized manner, each on one end of one of said side bearing units with a view to positioning said side bearing units.

13. The roll stand according to claim 10, which comprises a shim to be positioned by way of a jack between said end of a side bearing unit and one of said thrust units.

14. The roll stand according to claim 1, wherein each side bearing unit is configured to include a dismantling rail capable of being used for dismantling a corresponding one of said intermediate rollers.

15. A method of operating a roll stand, the roll stand including two working rollers configured for gripping a strip to be rolled, two intermediate rollers, two bearing rollers, and at least one side bearing unit configured for laterally supporting one of said working rollers, the roll stand including at least one camber block mounted for vertical movement relative to posts of the roll stand and configured for cambering the intermediate rollers, the method comprising:

supporting the side bearing unit with the camber block and adjusting the side bearing unit in position in order to:

first, hold the side bearing unit fixed relative to the working roller capable of being supported by said side bearing unit during axial movement of the intermediate roller capable of being in contact with the working roller;

second, hold the side bearing unit fixed relative to the intermediate roller during vertical movements thereof capable of being in contact with the working roller capable of being supported by the side bearing unit; and third, hold the side bearing unit fixed relative to the roll stand during dismantling of the intermediate rollers.

* * * * *